US007334272B2

(12) United States Patent
Liao

(10) Patent No.: US 7,334,272 B2
(45) Date of Patent: Feb. 26, 2008

(54) FLUSHING CONTROLLING MECHANISM

(76) Inventor: Fu-Chang Liao, No. 50, Lane 1412, Chunghua Rd., Toufen Chen, Miaoli Hsien (TW)

( * ) Notice: Subject to any disclaimer, the term of this patent is extended or adjusted under 35 U.S.C. 154(b) by 0 days.

(21) Appl. No.: 11/504,815

(22) Filed: Aug. 15, 2006

(65) Prior Publication Data

US 2007/0050902 A1 Mar. 8, 2007

(30) Foreign Application Priority Data

Aug. 16, 2005 (TW) ..... 94214034 U
Apr. 27, 2006 (TW) ..... 95207359 U

(51) Int. Cl.
*E03D 1/00* (2006.01)
*E03D 5/00* (2006.01)
*E03D 3/10* (2006.01)

(52) U.S. Cl. ..... 4/300; 4/415; 4/359

(58) Field of Classification Search ..... 4/354–362, 4/328, 415; 137/147–148
See application file for complete search history.

(56) References Cited

U.S. PATENT DOCUMENTS 1,461,163 A * 7/1923 Robinson ..... 251/55
3,813,701 A * 6/1974 Stevens ..... 4/362
5,579,542 A * 12/1996 Hayman ..... 4/374

* cited by examiner

*Primary Examiner*—Gregory L. Huson
*Assistant Examiner*—Kristie A. Mahone
(74) *Attorney, Agent, or Firm*—Alan Kamrath; Kamrath & Associates PA

(57) ABSTRACT

A flushing controlling mechanism includes a toilet bowl having a trap, a room, a hollow cylinder, a first piston, an inlet, an outlet and a first opening. The room selectively communicates with the trap via a first waste pipe, and a second waste pipe alternately communicates with the room. The hollow cylinder is received in the toilet bowl, and the first piston is movable inside the hollow cylinder. The inlet is adapted to be connected to a water source to allow water to flow into the water tank so as to move the first piston upward inside the hollow cylinder. The outlet selectively communicates with the trap of the toilet bowl. The first opening communicates with the suction space and the room of the toilet bowl. In addition, there is a device to accelerate downward movement of the first piston. Thus, the waste in the trap of the toilet bowl is sucked into the room and disposed from the second waste pipe.

7 Claims, 3 Drawing Sheets

FLUSHING CONTROLLING MECHANISM

BACKGROUND OF THE INVENTION

1. Field of the Invention

The present invention relates to a flushing controlling mechanism, and more particularly to a flushing controlling mechanism to save water used in the generation of a siphon effect.

2. Description of the Prior Art

When flushing a toilet, a large volume of water stored in a water tank is suddenly released to a drainage pipe to generate a siphon effect such that the polluted water in the toilet bowl is sucked into the drainage pipe. The suction of the polluted water is based on the siphon effect and the generation of the siphon effect is dependent on the sudden release of a large volume of water in the water tank. Therefore, in our daily life, a large amount of water is wasted merely for the generation of a siphon effect to suck the polluted water out of the toilet bowl.

To overcome these shortcomings, the present invention tends to provide an improved flushing controlling mechanism to mitigate the aforementioned problems.

SUMMARY OF THE INVENTION

The primary objective of the present invention is to provide an improved flushing controlling mechanism to effectively generate a siphon effect with a small amount of water such that water is saved.

In yet another objective of the present invention, an auxiliary compressed air tank is provided on a side of the flushing controlling mechanism to reinforce the generation of the siphon effect so as to help suck the polluted water away from the toilet bowl.

Other objects, advantages and novel features of the invention will become more apparent from the following detailed description when taken in conjunction with the accompanying drawings.

DETAILED DESCRIPTION OF THE PREFERRED EMBODIMENT

Figure 1:
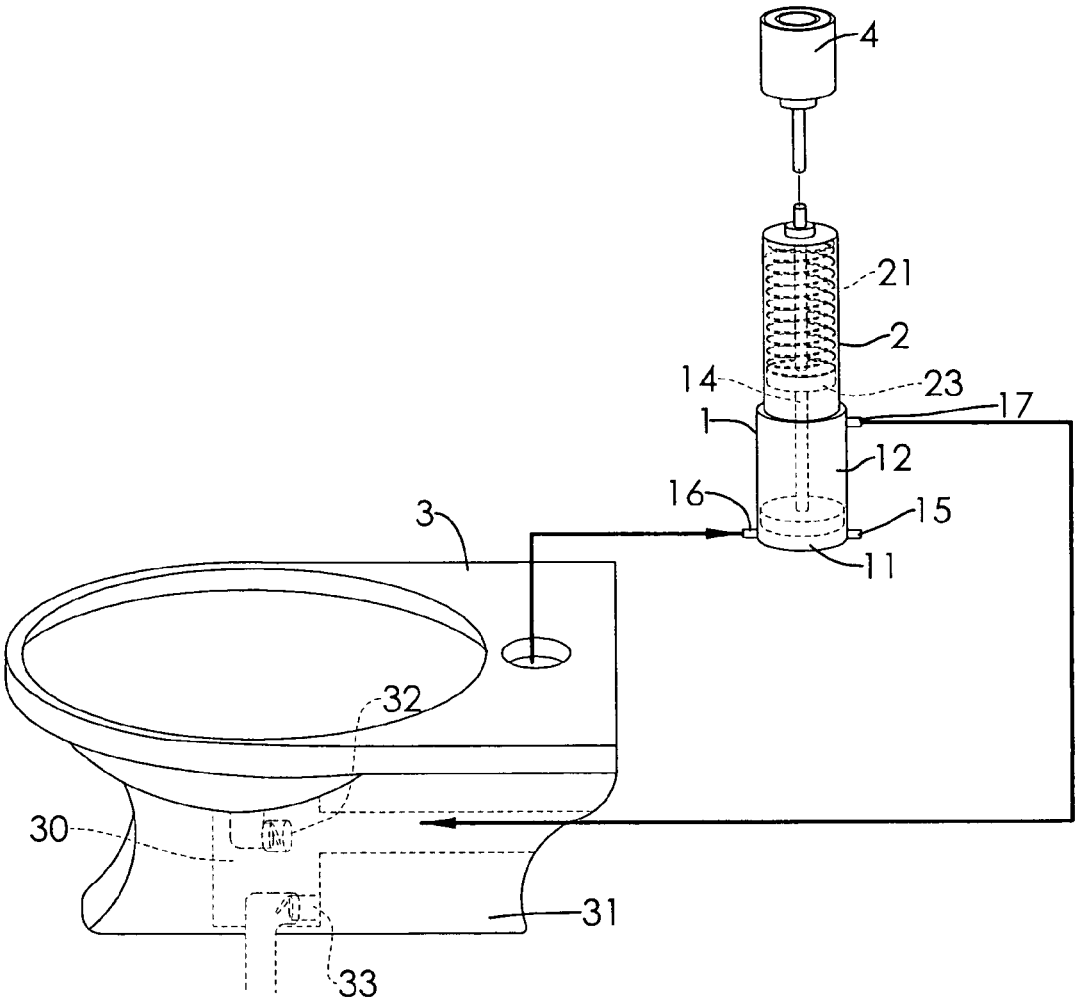
FIG. 1 is a schematic side plan view showing elements of the flushing mechanism of the present invention.
Figure 2:
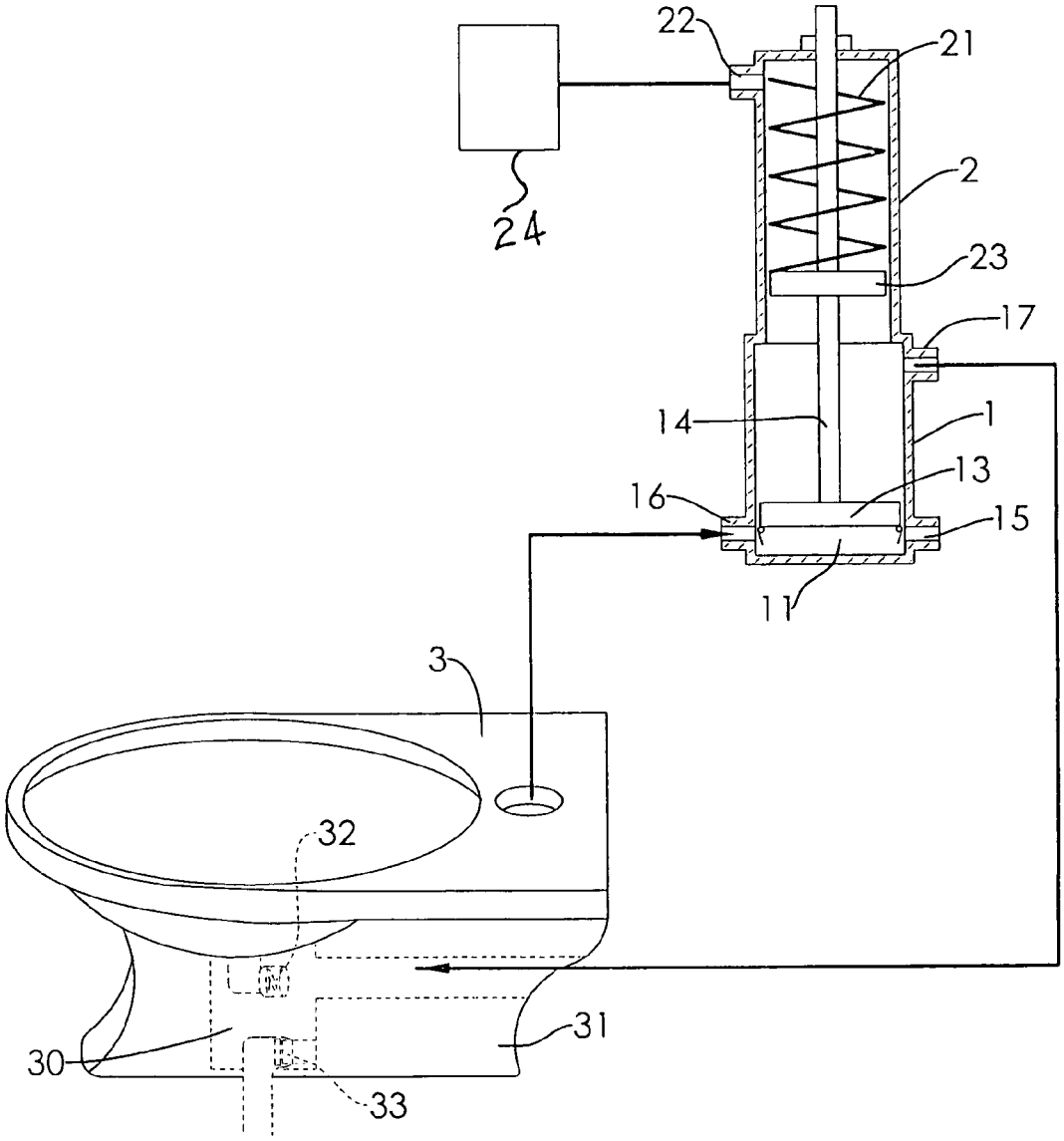
FIG. 2 is a schematic side plan view showing a different embodiment of the flushing controlling mechanism of the present invention.
Figure 3:
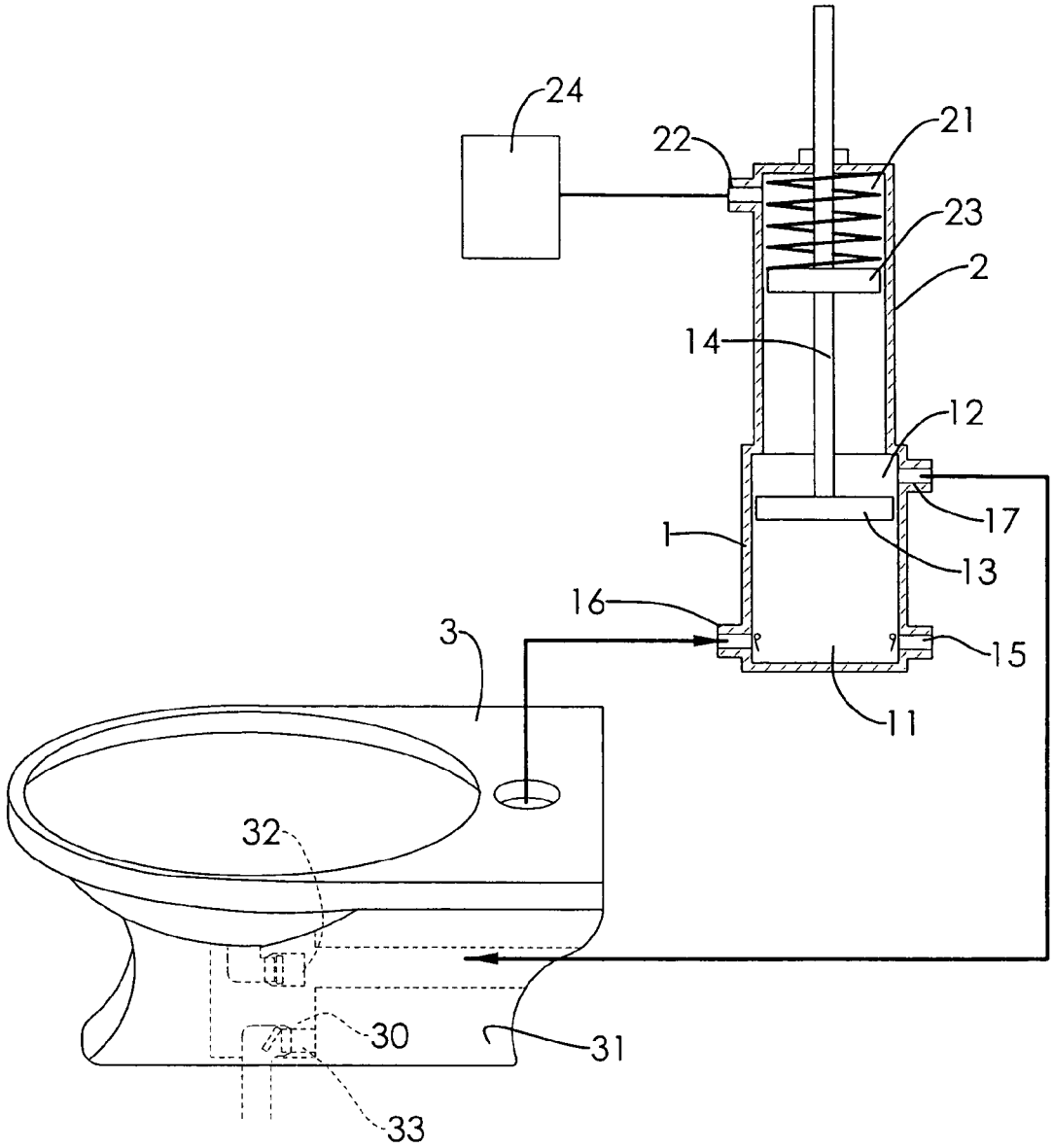
FIG. 3 is an operational view showing how the siphon effect works to suck out of wastes in the toilet bowl after the flushing controlling mechanism is assembled.

With reference to FIGS. 1, 2 and 3, it is noted that the flushing controlling mechanism in accordance with the present invention includes a first hollow cylinder (1), a second hollow cylinder (2) and a toilet bowl (3). The first hollow cylinder (1) and the second hollow cylinder (2) have different diameters.

The first hollow cylinder (1) is provided with a water tank (11), a suction space (12), a first piston (13) movably received inside the water tank (11) and the suction space (12), a linking rod (14) extending from a side face of the first piston (13), an inlet (15) in communication with the water tank (11) and an outlet (16) in communication with both the water tank (11) and the inlet (15). It is noted that the dimension of the water tank (11) as well as the suction space (12) is variable depending on position of the first piston (13). Therefore, when the first piston (13) is moving in a first direction, the dimension of the suction space (12) is increased and the dimension of the water tank (11) is decreased. On the other hand, when the first piston (13) is moving toward the second direction, the dimension of the suction space (12) is decreased and the dimension of the water tank (11) is increased. In order to completely separate the suction space (12) from the water tank (11) in a water-tight manner, a sealing ring (not shown) made of rubber or any suitable material is provided on an outer periphery of the first piston (13) such that when the first piston (13) moves inside the first hollow cylinder (1), there is no liquid exchange between the suction space (12) and the water tank (11).

The second hollow cylinder (2) has a second piston (23) fit and movably received inside the second hollow cylinder (2) and integrally connected to the linking rod (14) which extends from the first hollow cylinder (1). A spring (21) is mounted around the linking rod (14) and compressibly received between a side face of the second piston (23) and an inner face of the second hollow cylinder (2). Furthermore, the first hollow cylinder (1) is provided with a first opening (17) in communication with the suction space (12) and the second hollow cylinder (2) is provided with a second opening (22) in communication with an interior of the second hollow cylinder (2). A pipe is positioned between the first opening (17) and the room (31) to communicate with both the first opening (17) and the room (31).

The toilet bowl (3) is provided with a room (31) defined inside the toilet bowl (3), a first waste pipe (32) located between a trap (30) of the toilet bowl (3) and the room (31) to be selectively in communication with the room (31) and a second waste pipe (33) in selective communication with the room (31). Each of the first waste pipe (32) and the second waste pipe (33) is provided with a check valve (shown but not labeled) to allow the fist waste pipe (32) and the second waste pipe (33) to open only in one direction. A hole (34) is defined in the toilet bowl (3) to receive the combination of the first hollow cylinder (1) and the second hollow cylinder (2).

During the application of the flushing controlling mechanism of the present invention, the combination of the first hollow cylinder (1) and the second hollow cylinder (2) is received in the hole (34) of the toilet bowl (3) and the inlet (15) is connected to a water source (not shown) and the outlet (16) is connected to and communicates with a trap (30) of the toilet bowl (3). Thus when the water source starts to provide water to the water tank (11) of the first hollow cylinder (1), the water flowing into the water tank (11) of the first hollow cylinder (1) overcomes the recoil force of the spring (21) and pushes the first piston (13) to move upward. When the water pressure inside the water tank (11) of the first hollow cylinder (1) balances the recoil force of the spring (21), the water supply stops.

When a user pushes a button to open the outlet (16), water inside the water tank (11) flushes to the trap (30) of the toilet bowl (3). While the water is flushing to the trap (30) of the toilet bowl (3), the recoil force from the spring (21) that is applied directly onto the second piston (23), in combination with the load of a weight (4) that is directly on top of the linking rod (14), accelerates the downward movement of the first piston (13) and the second piston (23). While the first piston (13) is rapidly moving downward inside the first hollow cylinder (1), a quasi-vacuum effect is generated in the suction space (12). Because the suction space (12) is in communication with the room (31) via the pipe and the room (31) is in communication with the trap (30) of the toilet bowl (3), waste (not shown) in the trap (30) of the toilet bowl (3) is quickly sucked into the room (31) via the first waste pipe (32) and then is flushed out via the second waste pipe (33). As the waste is being sucked into the room (31), some of the waste may also be sucked into the suction space (12) via the pipe. However, due to the watertight seal between the water tank (11) and the suction space (12), there is no liquid exchange between the water tank (11) and the suction space (12). Thus there is no worry about contaminating the water in the water tank (11) by the waste inside the suction space (12). After the waste is flushed to the second waste pipe (33), the first piston (13) and the second piston (23) move to the bottom of the first hollow cylinder (1) and the second hollow cylinder (2), respectively, which triggers the provision of water from the water source. The electrical control mechanism of water supply from the water source is conventional in the art and is not the focus of the present invention, so detailed description thereof is omitted.

Because of the water pressure from the water source, the first piston (13) and the second piston (23) move upward to be ready for the next flushing procedure. In addition, when the first piston (13) is moving upward relative to the first hollow cylinder (1), the waste inside the suction space (12) is forced to flow back to the pipe and to the room (31) to be flushed in the next flushing process.

It is noted that due to the load from the weight (4) and the recoil force from the spring (21), movement of the first piston (13) downward inside the first hollow cylinder (1) is fast. As a result of the fast downward movement of the first piston (13), the vacuum effect inside the suction space (12) is generated. That is, the faster the movement of the first piston (13), the greater the suction force created inside the suction space (12).

With reference especially to FIG. 3, it is noted that in order to increase the downward movement of the first piston (13) and the second piston (23), and thereby increasing the magnitude of the vacuum effect in the suction space (12), a cylinder (24) which uses either hydraulic power or pneumatic power is connected to the second opening (22). Therefore, when the water in the water tank (11) starts flushing to the trap (30) of the toilet bowl (3), the cylinder (24) also starts providing additional force to the second piston (23) to increase the downward movement of the second piston (23) as well as the first piston (13), which increases the suction force in the suction space (12). As a result of the increased suction force in the suction space (12), the waste in the trap (30) of the toilet bowl (3) is quickly sucked to the room (31) and into the second waste pipe (33) to be disposed.

Therefore, it is noted that even with the weight (4) or the cylinder (24) providing an additional force helping the downward movement of the first piston (13) and the second piston (23), the suction force is generated primarily by the vacuum effect in the suction space (12), instead of the volume of water flushing to the trap (30) of the toilet bowl (3). Thus, a large volume of water is saved. Saving natural resources on the planet earth has become more important than ever before. Therefore, the flushing controlling mechanism of the present invention has an industrial application and a practical use.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flushing controlling mechanism comprising:

a toilet bowl having a trap for receiving therein waste, a room selectively communicating with the trap via a first waste pipe and a second waste pipe alternately communicating with the room;

a combination of a first hollow cylinder and a second hollow cylinder received in the toilet bowl, with the first hollow cylinder and the second hollow cylinder having different diameters, with the first hollow cylinder having a water tank, a suction space, a first piston movably inside the first hollow cylinder to separate the water tank from the suction space in a watertight manner, an inlet adapted to be connected to a water source to allow water to flow into the water tank so as to move the first piston upward inside the first hollow cylinder, an outlet selectively communicating with the trap of the toilet bowl and a first opening communicating with the suction space and the room of the toilet bowl, and with a second piston being fit and movably received inside the second hollow cylinder and connected to the first piston by a linking rod; and means for accelerating downward movement of the first piston and the second piston for generation of a vacuum effect in the suction space such that waste in the trap of the toilet bowl is sucked into the room and disposed from the second waste pipe.

2. The flushing controlling mechanism as claimed in claim 1, wherein the accelerating means comprises:

a spring compressibly received between a side face of the second piston and an inner face of the second hollow cylinder so that when the first piston is pushed upward by the water from the water source, the spring is compressed and when a recoil force from the compressed spring is released, the second piston as well as the first piston are accelerated to move downward relative to the second hollow cylinder and the first hollow cylinder respectively.

3. The flushing controlling mechanism as claimed in claim 1, wherein the accelerating means comprises a weight positioned on top of the first piston so as to increase downward movement of the first piston.

4. The flushing controlling mechanism as claimed in claim 2, wherein the accelerating means further has a weight positioned on a free end of the linking rod so as to increase downward movement of the first piston and magnitude of the vacuum effect.

5. The flushing controlling mechanism as claimed in claim 2, wherein the accelerating means further comprises a cylinder in connection to a second opening which communicates with the second hollow cylinder such that additional force pushing the second piston downward is provided from the cylinder.

6. The flushing controlling mechanism as claimed in claim 3, wherein the accelerating means further comprises a cylinder in connection to a second opening which communicates with the second hollow cylinder such that additional force pushing the second piston downward is provided from the cylinder.

7. The flushing controlling mechanism as claimed in claim 4, wherein the accelerating means further comprises a cylinder in connection to a second opening which communicates with the second hollow cylinder such that additional force pushing the second piston downward is provided from the cylinder.

* * * * *